US007097483B2

(12) United States Patent
Hayashi

(10) Patent No.: US 7,097,483 B2
(45) Date of Patent: Aug. 29, 2006

(54) WATERPROOF CONNECTOR ASSEMBLY, WATERPROOF CONNECTOR AND WATERPROOF CONNECTOR HOUSING

(75) Inventor: Toshiaki Hayashi, Aichi (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/272,324

(22) Filed: Nov. 10, 2005

(65) Prior Publication Data

US 2006/0105629 A1 May 18, 2006

(30) Foreign Application Priority Data

Nov. 15, 2004 (JP) ..... 2004-331126

(51) Int. Cl.
*H01R 13/52* (2006.01)

(52) U.S. Cl. ..... 439/271

(58) Field of Classification Search ..... 439/271–274, 439/278, 587

See application file for complete search history.

(56) References Cited

U.S. PATENT DOCUMENTS 6,443,766 B1 * 9/2002 Ichio et al. ..... 439/587

FOREIGN PATENT DOCUMENTS

JP 2003-077578 3/2003

* cited by examiner

*Primary Examiner*—Javaid H. Nasri
(74) *Attorney, Agent, or Firm*—Barley Snyder LLC

(57) ABSTRACT

A waterproof connector assembly comprises a waterproof connector having an insulating housing with a housing main body and a mating member that extends from the housing main body. A sealing member is attached to an outer periphery of the mating member. A sealing member cover is supported on the insulating housing and is moveable between an initial position where the sealing member cover is positioned on an outside surface of the sealing member and a final position where the sealing member cover is positioned on an outside surface of the housing main body. A locking arm extends from the insulating housing and locks the sealing member cover in the initial position. A mating connector has an insulating mating connector housing with a mating member receiving recess. The locking arm locks the mating connector to the waterproof connector when the sealing member cover is in the final position.

26 Claims, 9 Drawing Sheets

WATERPROOF CONNECTOR ASSEMBLY, WATERPROOF CONNECTOR AND WATERPROOF CONNECTOR HOUSING

FIELD OF THE INVENTION

The invention relates to a waterproof connector assembly comprising a waterproof connector and a mating connector wherein the waterproof connector has a sealing member. The invention further relates to a waterproof connector and waterproof connector housing for such an assembly.

BACKGROUND OF THE INVENTION

Waterproof connectors have conventionally been used, for example, to make electrical connections in automobiles. One example of a waterproof connector is disclosed in JP 2003-77578 A and shown in FIG. 9. As shown in FIG. 9, the waterproof connector 101 comprises a waterproof connector housing 110 formed by molding an insulating resin. The waterproof connector housing 110 has a mating section 111 that mates from a front side (left side of FIG. 9) of the waterproof connector housing 110 with a mating connector (not shown). The mating section 111 is provided with a plurality of contact accommodating cavities 112 that receive contacts 120. A housing lance 113 for locking each of the contacts 120 in position is provided inside each of the contact accommodating cavities 112. Electrical wires W are connected to the contacts 120. A rubber wire sealing member 121 is provided around each of the electrical wires W. The wire sealing members 121 seal the contacts 120 accommodated inside the contact accommodating cavities 112 with respect to an outside of the waterproof connector housing 110.

A rubber annular sealing member 114 is attached to a periphery of the mating section 111 and forms a seal between the mating section 111 of the waterproof connector housing 110 and a mating section of the mating connector (not shown). A hood 115 covers a periphery of the sealing member 114 and the mating section 111. The hood 115 protects the sealing member 114 before the mating connector (not shown) is mated with the waterproof connector housing 110. A front retainer 117 is inserted into the mating section 1 11 from the front side of the waterproof connector housing 110. The front retainer 117 can be locked with the mating section 111 in a temporary locking position and a main locking position. A space 116 into which walls of the mating section of the mating connector (not shown) advance is formed between the hood 115 and the front retainer 117.

When the mating connector (not shown) and the waterproof connector 101 are mated, the contacts 120 of the waterproof connector 101 come into mechanical and electrical contact with contacts (not shown) in the mating connector (not shown). As the mating connector (not shown) is mated with the waterproof connector 101, walls of the mating section of the mating connector (not shown) advance into the space 116, and the walls compress an outer circumference of the sealing member 114 inward so that a seal is created between the mating section of the mating connector (now shown) and the mating section 111 of the waterproof connector 101 by the sealing member 114. As a result, the invasion of water into an interior of the mating section 111 can be prevented.

When the mating connector (not shown) mates with the waterproof connector 101, since the walls of the mating section of the mating connector (not shown) compress the outer circumference of the sealing member 114 inward, resistance is large in comparison with the force required for this compression. Thus, the force required when the mating connection (not shown) is mated with the waterproof connector 101 is excessively large, and the working characteristics are poor. Additionally, because the hood 115 that protects the sealing member 114 protrudes outward with respect to the mating section 111 to form the space 116, the external size of the waterproof connector housing 110 is large.

BRIEF SUMMARY OF THE INVENTION

It is therefore an object of the invention to provide a waterproof connector assembly, a waterproof connector and a waterproof connector housing that can appropriately protect a sealing member while reducing the external size of the waterproof connector housing. It is another object of the invention is to provide a waterproof connector assembly, a waterproof connector and a waterproof connector housing that make it possible to reduce the force required to mate the waterproof connector with a mating connector.

This and other objects are achieved by waterproof connector comprising an insulating housing with a housing main body and a mating member that extends from the housing main body. The insulating housing has a plurality of contact accommodating cavities extending there through. A sealing member is attached to an outer periphery of the mating member. A sealing member cover is supported on the insulating housing and is moveable between an initial position where the sealing member cover is positioned on an outside surface of the sealing member and a final position where the sealing member cover is positioned on an outside surface of the housing main body.

This and other objects are further achieved by a waterproof connector assembly comprising a waterproof connector and a mating connector. The waterproof connector has an insulating housing with a housing main body and a mating member that extends from the housing main body. The insulating housing has a plurality of contact accommodating cavities extending there through. A sealing member is attached to an outer periphery of the mating member. A sealing member cover is supported on the insulating housing and is moveable between an initial position where the sealing member cover is positioned on an outside surface of the sealing member and a final position where the sealing member cover is positioned on an outside surface of the housing main body. The mating connector has an insulating mating connector housing with a mating member receiving recess that receives the mating member when the waterproof connector and the mating connector are mated. The mating connector has outer walls that engage the sealing member cover to move the sealing member cover from the initial position to the final position.

This and other objects are still further achieved by a waterproof connector assembly comprising a waterproof connector and a mating connector. The waterproof connector has an insulating housing with a housing main body and a mating member that extends from the housing main body. The insulating housing has a plurality of contact accommodating cavities extending there through. A sealing member is attached to an outer periphery of the mating member. A sealing member cover is supported on the insulating housing and is moveable between an initial position where the sealing member cover is positioned on an outside surface of the sealing member and a final position where the sealing member cover is positioned on an outside surface of the housing main body. A locking arm extends from the insulating housing and locks the sealing member cover in the initial position. The mating connector has an insulating mating connector housing with a mating member receiving recess that receives the mating member when the waterproof connector and the mating connector are mated. The locking arm locks the mating connector to the waterproof connector when the sealing member cover is in the final position.

DETAILED DESCRIPTION OF THE INVENTION

Figure 1A:
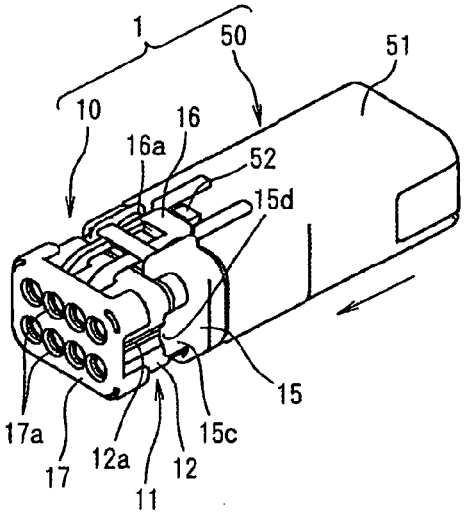
FIG. 1A is a perspective view showing an initial state of mating between a waterproof connector and a mating connector.
Figure 1B:
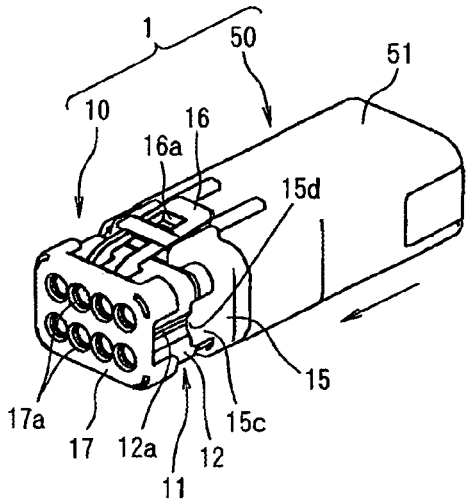
FIG. 1B is a perspective view showing an intermediate state of mating between the waterproof connector and the mating connector.
Figure 1C:
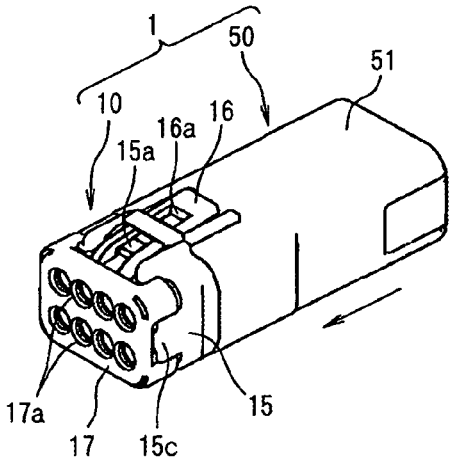
FIG. 1C is a perspective view showing a state immediately prior to a final state of mating between the waterproof connector and the mating connector.
Figure 1D:
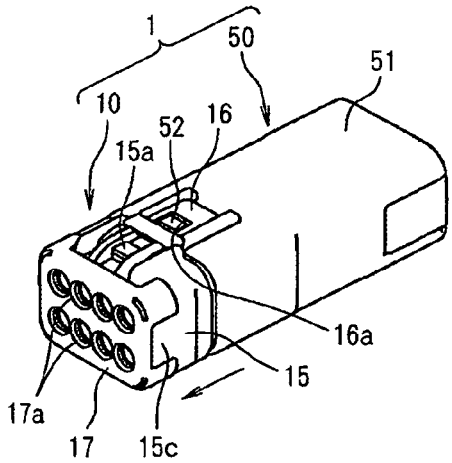
FIG. 1D is a perspective view showing the final state of mating between the waterproof connector and the mating connector.
Figure 2A:
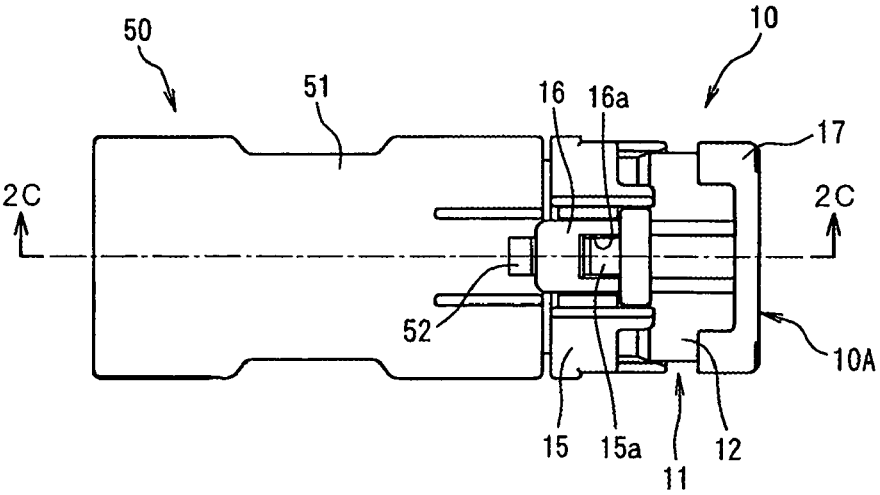
FIG. 2A is a plan view of FIG. 1A.
Figure 2B:
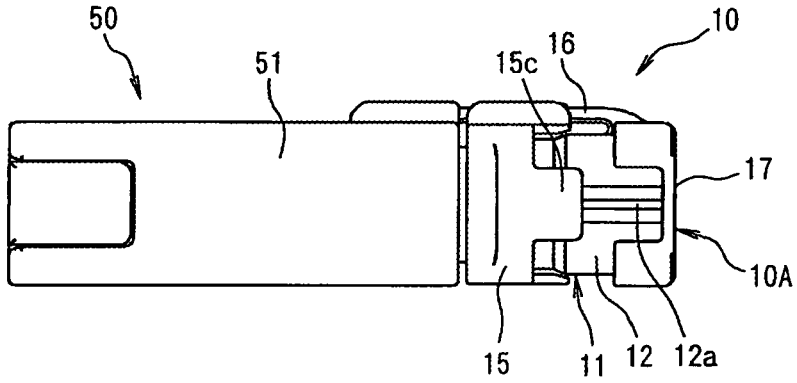
FIG. 2B is a side view of FIG. 1A.
Figure 2C:
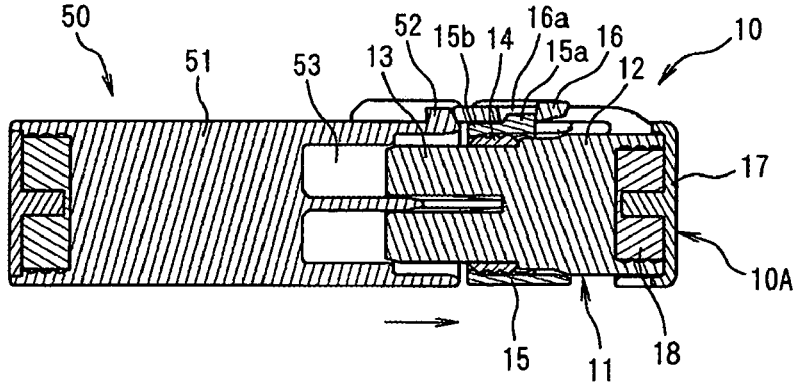
FIG. 2C is a sectional view along line 2C—2C of FIG. 2A.

FIGS. 1A–1D show a waterproof connector assembly 1 according to the invention. As shown in FIGS. 1A–1D, the waterproof connector assembly 1 consists of a waterproof connector 10 and a mating connector 50 that mates with the waterproof connector 10. As shown in FIGS. 7A–8F, the waterproof connector 10 comprises a waterproof connector housing 10A with an insulating housing 11. The housing 11 has a substantially rectangular housing main body 12 and a mating member 13 that extends forward from the housing main body 12 and mates with the mating connector 50. The mating member 13 extends forward from the housing main body 12 via a reduced-diameter inclined member and has a substantially rectangular shape with vertical and horizontal diameters being reduced compared to the housing main body 12. Guide grooves 12*a* that extend in a forward-rearward direction are formed on both side walls of the housing main body 12. A locking arm 16 extends forward from a rear end portion of an upper surface of the housing main body 12 substantially parallel thereto. The locking arm 16 may be formed as an integral unit with the housing 11. The locking arm 16 is provided with an engagement opening 16*a*. The housing 11 is formed, for example, by molding an insulating resin.

A plurality of contact accommodating cavities 13*a* that accommodate contacts (not shown) are provided inside the housing main body 12 and the mating member 13. Each of the contact accommodating cavities 13*a* passes through the housing 11 in a forward-rearward direction and includes a housing lance (not shown) that engages an inside of the corresponding contacts (not shown) to lock the contacts (not shown) therein. Each of the contacts (not shown) may be formed, for example, by stamping and forming a metal plate. The contacts (not shown) comprise a contact member (not shown) that makes contact with a corresponding contact (not shown) provided in the mating connector 50 and an electrical wire connecting member (not shown) that connects to an electrical wire (not shown). The contacts (not shown) to which the electrical wires (not shown) have been connected are accommodated in the contact accommodating cavities 13*a* of the housing 11 so that the electrical wires (not shown) extend rearward with respect to the housing 11.

As shown in FIGS. 8A–8F, an annular sealing member 14 made, for example from rubber, is attached to an outer circumference of the mating member 13 of the housing 11 and is positioned toward the housing main body 12. The sealing member 14 may be integrally molded (co-injection molding) with the housing 11 or may be constructed as a separate unit from the housing 11 and fitted over the mating member 13. As shown in FIGS. 7A–8F, an annular sealing member cover 15 made, for example, from a resin is supported on the housing main body 12. The sealing member cover 15 is designed to slide in a direction of mating of the mating connector 50 and the waterproof connector 10. The sealing member cover 15 is movable between an initial position shown in FIGS. 7A–7F and 2A–2C where it is positioned on an outside surface of the sealing member 14 and a final position shown in FIGS. 8A–8F and 5A–5C where it is positioned on an outside surface of the housing main body 12. The sealing member cover 15 compresses the sealing member 14 from the outside when located in the initial position.

Figure 7A:
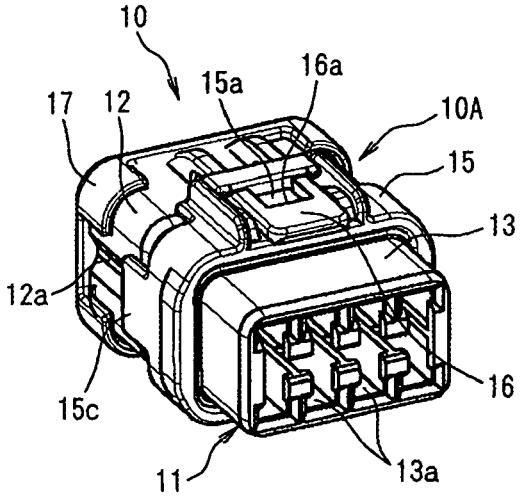
FIG. 7A is a perspective view of the mating member cover in an initial position as seen from a front at an inclination from above.
Figure 7D:
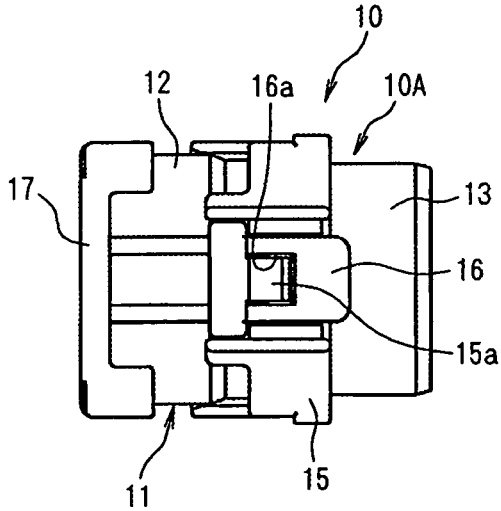
FIG. 7D is a plan view of the mating member cover in the initial position.
Figure 7B:
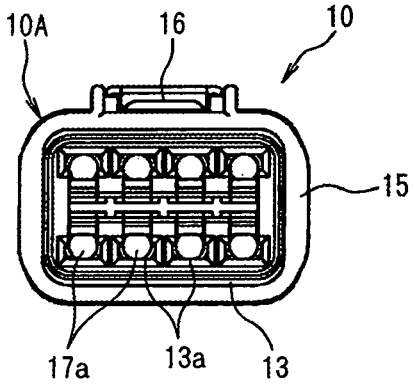
FIG. 7B is a front view of the mating member cover in the initial position.
Figure 7E:
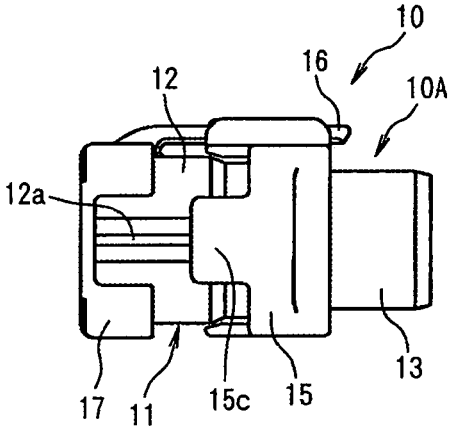
FIG. 7E is a side view of the mating member cover in the initial position.
Figure 7C:
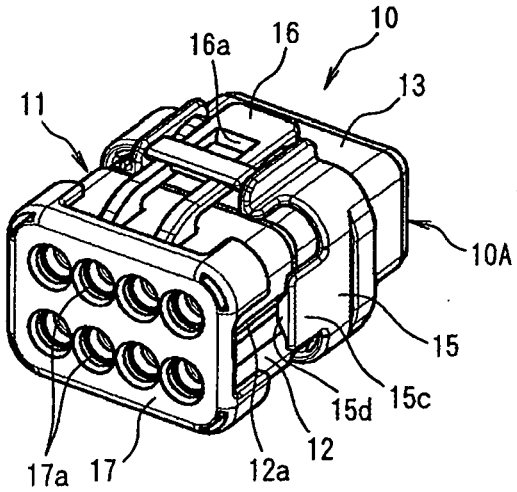
FIG. 7C is a perspective view of the mating member cover in the initial position as seen from a rear at an inclination from above.
Figure 7F:
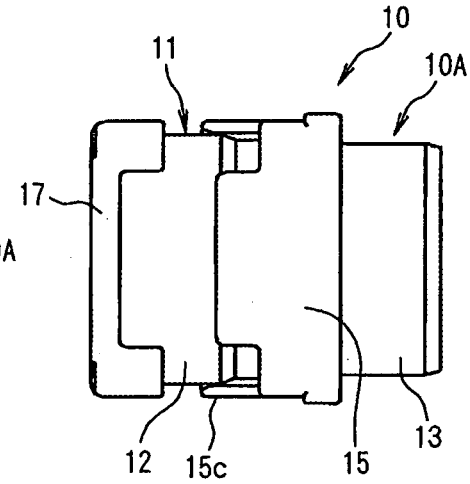
FIG. 7F is a bottom view of the mating member cover in the initial position.
Figure 8A:
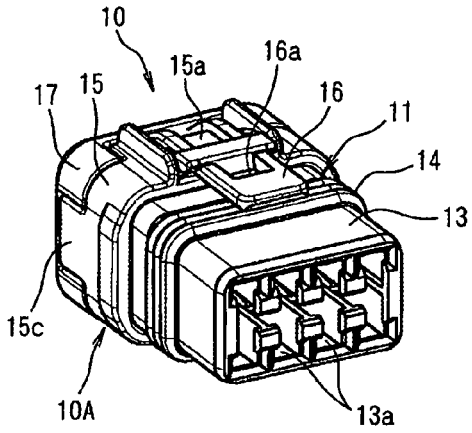
FIG. 8A is a perspective view of the sealing member cover in a final position as seen from the front at an inclination from above.
Figure 8D:
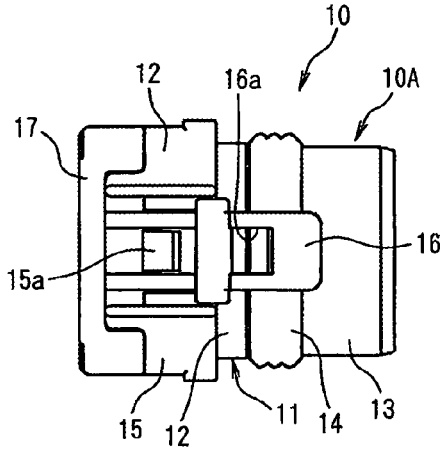
FIG. 8D is a plan view of the sealing member cover in the final position.
Figure 8B:
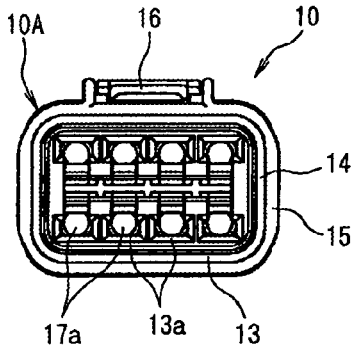
FIG. 8B is a front view of the sealing member cover in the final position.
Figure 8E:
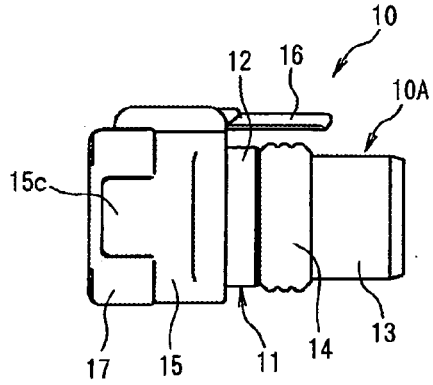
FIG. 8E is a side view of the sealing member cover in the final position.
Figure 8C:
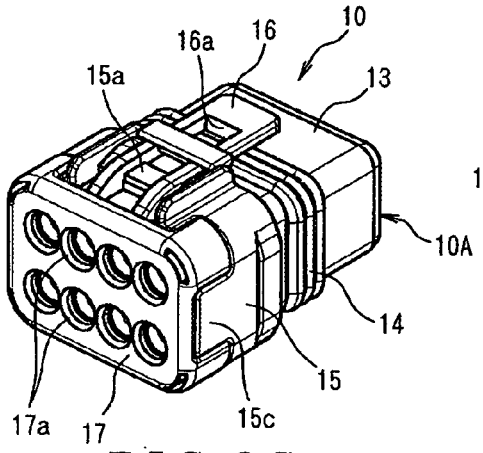
FIG. 8C is a perspective view of the sealing member cover in the final position as seen from the rear at an inclination from above
Figure 8F:
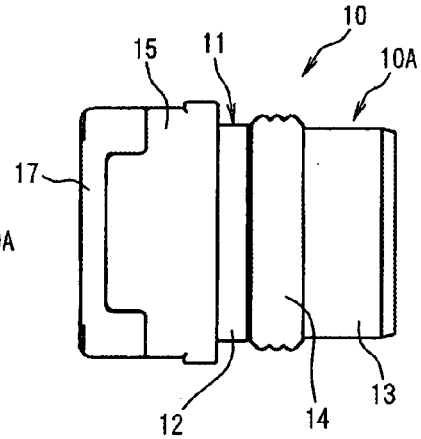
FIG. 8F is a bottom view of the sealing member cover in the final position.
Figure 9:
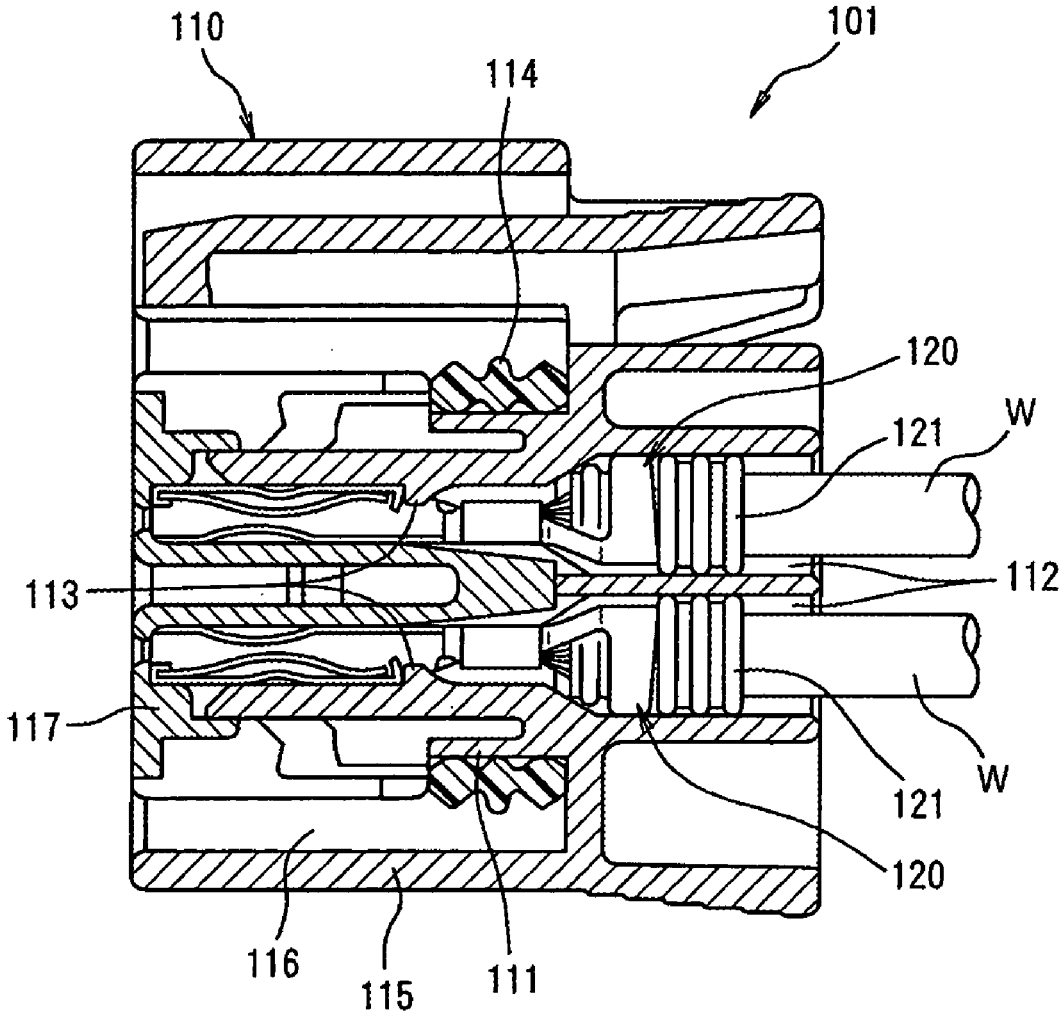
Prior Art FIG. 9
FIG. 9 is a sectional view of a waterproof connector according to the prior art.

A locking projection 15*a* protrudes from an upper portion of the sealing member cover 15 and is formed to enter the engagement opening 16*a* formed on the locking arm 16 when the sealing member cover 15 is in the initial position. As shown in FIG. 5C, an engaging member 15*b* is provided on a front end of the upper portion of the sealing member cover 15 and is formed to lift the locking arm 16 when the sealing member cover 15 is moved from the final position to the initial position. As shown in FIG. 7C, protruding parts 15*c* that protrude rearward are formed on both side portions of the sealing member cover 15. Guide members 15*d* that guide the movement of the sealing member cover 15 along the guide grooves 12*a* formed in the housing main body 12 are formed on an inside surface of the protruding parts 15*c*.

As shown in FIG. 5C, an electrical wire sealing member 18 is disposed around the electrical wires (not shown) connected to the contacts (not shown) that are accommodated in the housing 11. The electric wire sealing member 18 creates a seal between the housing main body 12 and the electrical wires (not shown), thus preventing the entry of water from an outside of the housing 11. An electrical wire sealing member cover 17 is attached to the housing main body 12 from the rear of the housing main body 12 so that the electrical wire sealing member 18 is covered. As shown in FIG. 7C, a plurality of electrical wire receiving apertures 17*a* through which the electrical wires (not shown) extend are formed in the electrical wire sealing member cover 17.

Figure 5A:
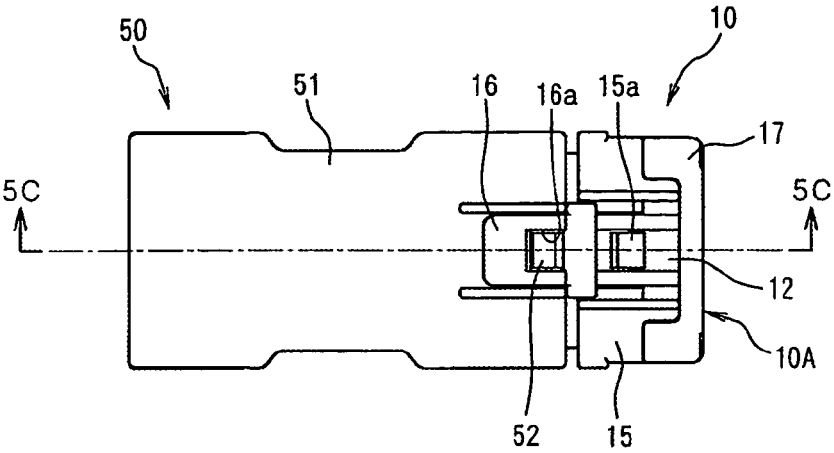
FIG. 5A is a plan view of FIG. 1D.
Figure 5B:
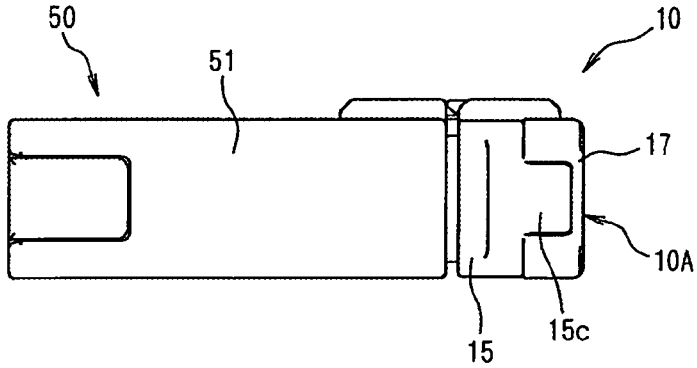
FIG. 5B is a side view of FIG. 1D.
Figure 5C:
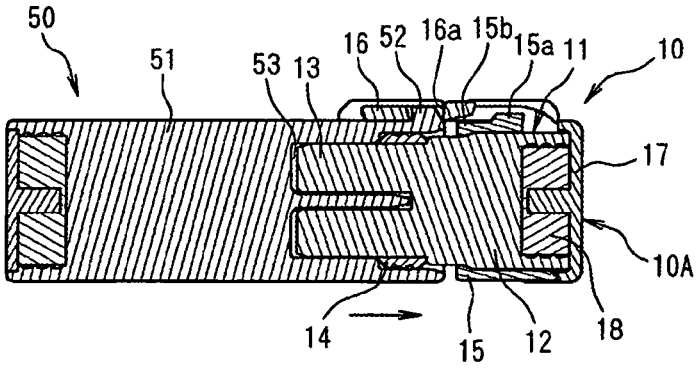
FIG. 5C is a sectional view along line 5C—5C of FIG. 5A.

As shown in FIGS. 5A–5C, the mating connector 50 comprises an insulating mating housing 51 provided with a plurality of mating contacts (not shown). A mating member receiving recess 53 is formed in the mating housing 51 and accommodates the mating member 13 of the waterproof connector 10. A locking projection 52 protrudes upward from a tip end of an upper wall that demarcates the mating member receiving recess 53. This locking projection 52 is designed to enter the engagement opening 16*a* formed in the locking arm 16 of the waterproof connector 10 at the time of completion of the mating with the waterproof connector 10, as shown in FIGS. 5A–5C.

A method of mating the waterproof connector 10 with the mating connector 50 will now be described. Prior to the mating of the mating connector 50 with the waterproof connector 10, the sealing member cover 15 is located in the initial position where it is positioned on an outside surface of the sealing member 14 so that the sealing member 14 is not exposed to the outside. In this position, the sealing member cover 15 compresses the sealing member 14 from the outside. The sealing member 14 is compressed with respect to the outer periphery of the mating member 13 of the housing 11. The locking projection 15*a* of the sealing member cover 15 engages with the engagement opening 16*a* in the locking arm 16 so that the sealing member cover 15 is locked by the locking arm 16 in the initial position.

Accordingly, the sealing member 14 is protected from the outside by the sealing member cover 15, and the sealing member cover 15 is maintained in this state so that protection of the sealing member 14 can be securely accomplished. Additionally, because the sealing member cover 15 compresses the sealing member 14, it is not necessary for the mating connector 50 to further compress the sealing member 14 when the mating connector 50 mates with the waterproof connector 10. Thus, it is possible to reduce the force required to mate the waterproof connector 10 and the mating connector 50, prevent positional deviation of the sealing member 14, and prevent the entry of dust or the like between the sealing member 14 and the mating member 13.

The mating connector 50 mates with the waterproof connector 10 by moving the mating connector 50 in the direction of the arrow in FIGS. 1A–1D and 2C. The mating member 13 of the waterproof connector 10 enters an interior of the mating member receiving recess 53 in the mating connector 50, and the locking projection 52 provided on the outer walls contact the front end of the locking arm 16. As shown in FIGS. 1B and 3A–3C, when the mating connector 50 is further pushed into the waterproof connector 10, the outer walls contact the front end of the sealing member cover 15 while the locking projection 52 lifts the front end of the locking arm 16. As shown in FIGS. 1C and 4A–4C, when the mating connector 50 is further pushed into the waterproof connector 10, the locking projection 52 further lifts the locking arm 16 and is located directly beneath the engagement opening 16*a* in the locking arm 16. The outer walls push the sealing member cover 15 and releases the locked state of the sealing member cover 15 so that the sealing member cover 15 slides over the housing main body 12 and moves from the initial position toward the final position. In the final position, the sealing member cover 15 is located toward the rear and apart from the tip end of the outer walls of the mating connector 50. Since the sealing member cover 15 moves, confirmation that the mating connector 50 and the waterproof connector 10 have been fully mated can be confirmed by looking at the position of the sealing member cover 15.

The outer walls of the mating connector 50 press the periphery of the sealing member 14. As a result, a seal is formed between the mating member 13 and the outer walls of the mating connector 50 so that the invasion of water from the outside of the housing 11 is prevented. As shown in FIGS. 1D and 5A–5C, as the locking arm 16 is displaced downward, the locking projection 52 enters the engagement opening 16*a*. The locking arm 16 locks the locking projection 52. As a result, the locking arm 16 locks the sealing member cover 15 in the initial position prior to the mating with the mating connector 50, and locks the locking projection 52 provided on the mating connector 50 when the mating with the mating connector 50 has been completed.

Since the sealing member cover 15 is movable, there is no need to form a hood that protects the sealing member 14 or to fasten the hood to the housing 11 beforehand, as in the past. It is therefore possible to protect the sealing member 14 while appropriately reducing the external size of the waterproof connector housing 10A. As shown in FIG. 5C, the sealing member 14 forms a seal between the mating member 13 and the outer walls of the mating connector 50 to prevent the entry of water from an outside of the housing 11.

Figure 3A:
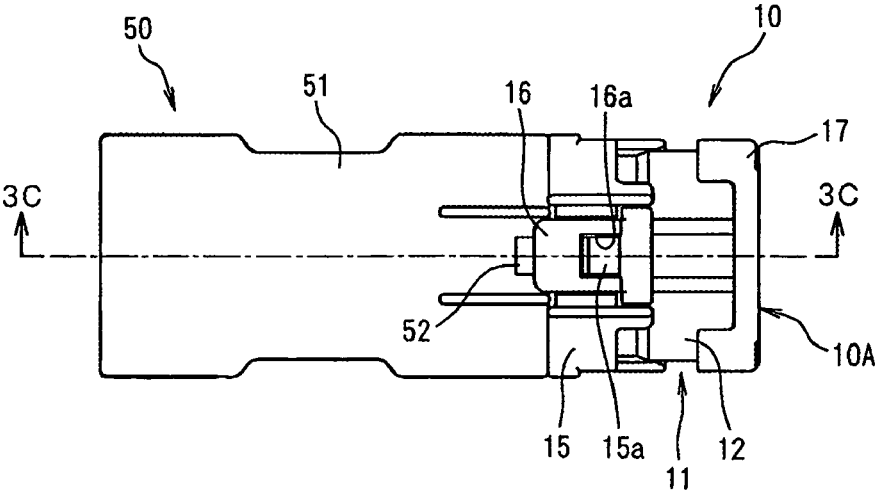
FIG. 3A is a plan view of FIG. 1B.
Figure 3B:
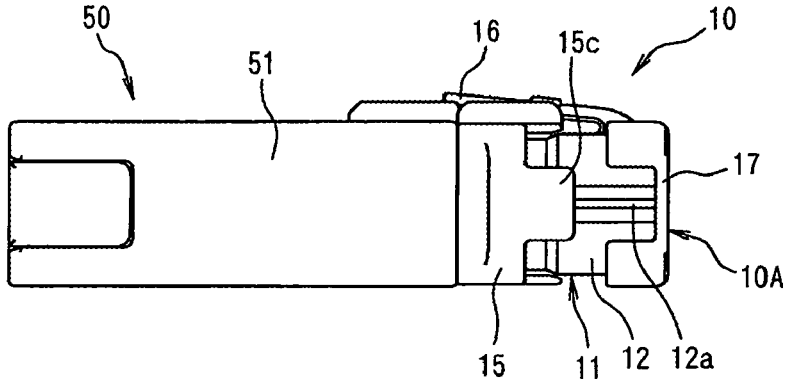
FIG. 3B is a side view of FIG. 1B.
Figure 3C:
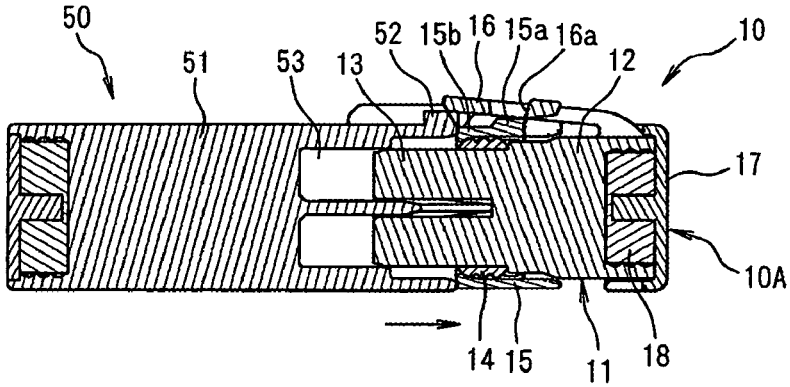
FIG. 3C is a sectional view along line 3C—3C of FIG. 3A.
Figure 4A:
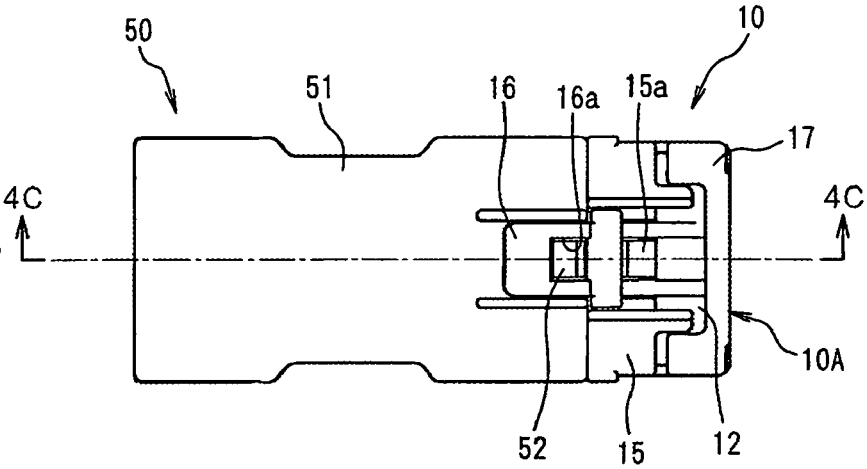
FIG. 4A is a plan view of FIG. 1C.
Figure 4B:
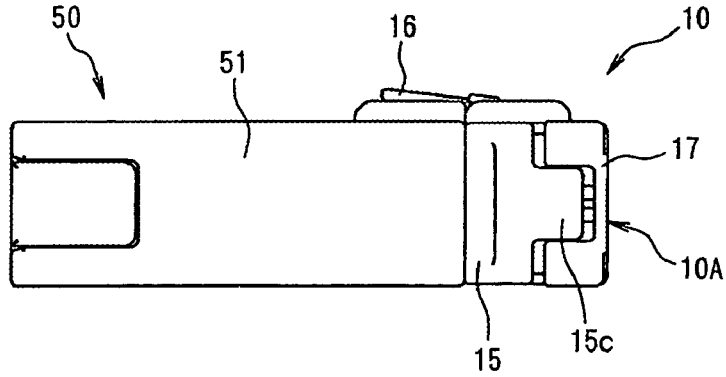
FIG. 4B is a side view of FIG. 1C.
Figure 4C:
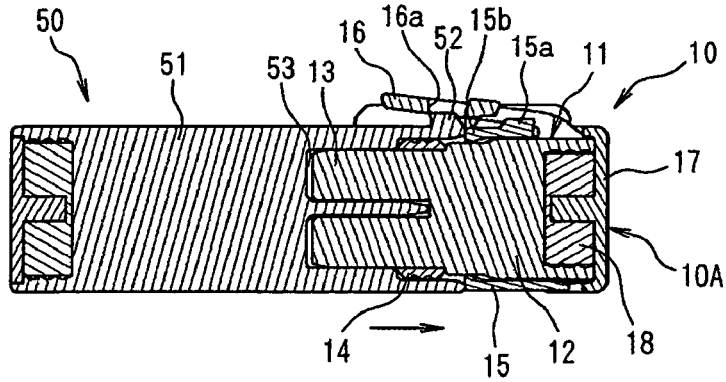
FIG. 4C is a sectional view along line 4C—4C of FIG. 4A.
Figure 6A:
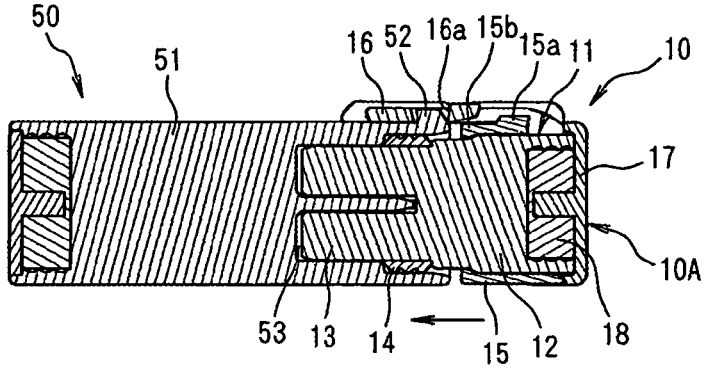
FIG. 6A is a sectional view of an initial state of release of the mating state between the waterproof connector and the mating connector.
Figure 6B:
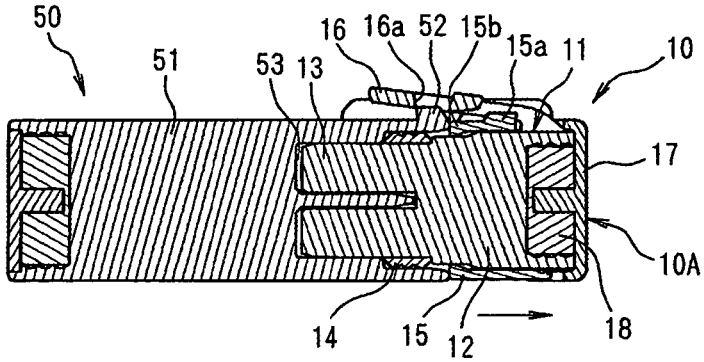
FIG. 6B is a sectional view of a first intermediate state of release of mating between the waterproof connector and the mating connector.
Figure 6C:
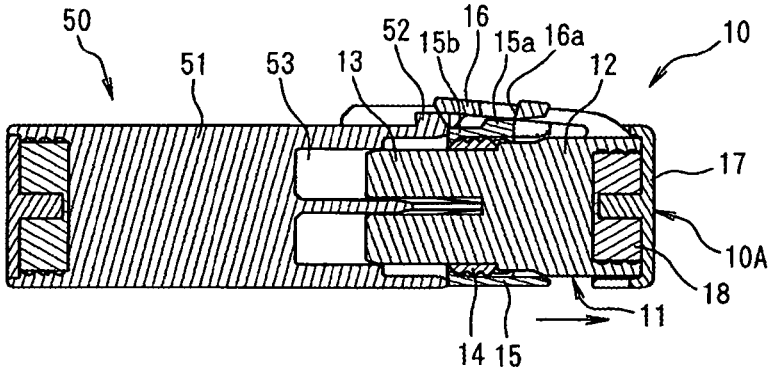
FIG. 6C is a sectional view of a second intermediate state of release of the mating state between the waterproof connector and the mating connector.

A method for releasing the waterproof connector 10 from the mating connector 50 will now be described. As shown in FIGS. 6A–6D, when the mating of the waterproof connector 10 and the mating connector 50 is to be released, the sealing member cover 15 is first moved from the final position to the initial position in a direction of the arrow in FIG. 6A. As shown in FIG. 6B, the engaging member 15*b* of the sealing member cover 15 contacts a bottom surface of the locking arm 16, lifts the locking arm 16, and causes the locking projection 52 to be removed from the engagement opening 16*a* to release the locked state of the locking projection 52, as shown in FIGS. 3C and 4C. Accordingly, it is not necessary to use a jig for releasing the locked state of the locking projection 52, and it is not necessary for a worker to lift the locking arm 16 using his or her fingers. The front end of the sealing member cover 15 contacts the tip end of the outer walls of the mating connector 50. The housing 11 of the waterproof connector 10 is pulled in a direction of the arrow in FIG. 6C to maintain a state in which the front end of the sealing member cover 15 is in contact with the tip end of the outer walls of the mating connector 50 until the sealing member cover 15 is positioned in the initial position.

Figure 6D:
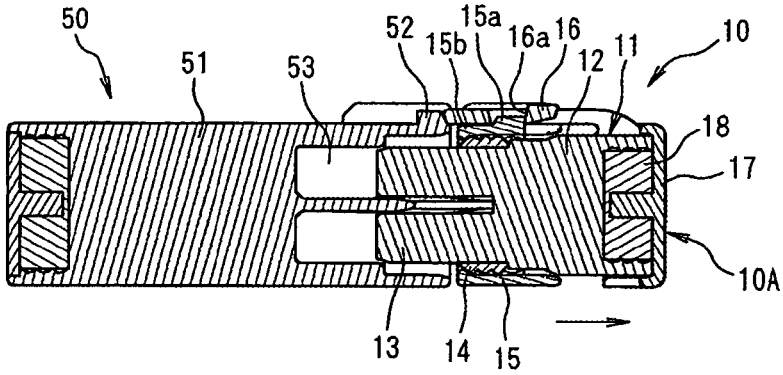
FIG. 6D is a sectional view of the completed state of release of the mating state between the waterproof connector and the mating connector.

When the housing 11 of the waterproof connector 10 is pulled further rearward, as shown in FIG. 6D, the sealing member cover 15 maintains the initial position, the locking arm 16 displaces downward, and the locking projection 15*a* of the sealing member cover 15 enters the engagement opening 16*a* in the locking arm 16. As a result, the release of the waterproof connector 10 and the mating connector 50 is completed. Even after the mating is released, the sealing member cover 15 is maintained in the initial position so that the sealing member 14 is not exposed to the outside, and the sealing member 14 can be protected from the outside by the sealing member cover 15.

An embodiment of the present invention was described above. However, the present invention is not limited to this embodiment, and various alterations or modifications can be made. For example, it is not necessary that the sealing member cover 15 compress the sealing member 14 in the initial position. Furthermore, it is not necessary to form the engaging member 15*b* so that the engaging member 15*b* lifts the locking arm 16 when the sealing member cover 15 is moved from the final position to the initial position. It is, therefore, intended that the foregoing description be regarded as illustrative rather than limiting, and that the scope of the invention is given by the appended claims together with their full range of equivalents.

What is claimed is:

1. A waterproof connector, comprising:

an insulating housing with a housing main body and a mating member that extends from the housing main body, the insulating housing having a plurality of contact accommodating cavities extending there through;

a sealing member attached to an outer periphery of the mating member; and a sealing member cover supported on the insulating housing and moveable between an initial position where the sealing member cover is positioned on an outside surface of the sealing member and a final position where the sealing member cover is positioned on an outside surface of the housing main body.

2. The waterproof connector of claim 1, wherein the sealing member cover compresses the outer periphery of the sealing member in the initial position.

3. The waterproof connector of claim 1, wherein the sealing member cover slides over the insulating housing between the initial position and the final position with respect to a direction of mating of a mating connector.

4. The waterproof connector of claim 1, further comprising a locking arm that locks the sealing member cover in the initial position.

5. The waterproof connector of claim 4, further comprising an engaging member that lifts the locking arm when the sealing member cover moves from the final position to the initial position.

6. The waterproof connector of claim 1, wherein the housing main body includes guide grooves that correspond with guide members of the sealing member cover.

7. The waterproof connector of claim 1, wherein the mating member has a smaller diameter than the housing main body.

8. The waterproof connector of claim 1, further comprising an electric wire sealing member attached to the housing main body.

9. A waterproof connector assembly, comprising:

a waterproof connector having an insulating housing with a housing main body and a mating member that extends from the housing main body, the insulating housing having a plurality of contact accommodating cavities extending there through, a sealing member attached to an outer periphery of the mating member, a sealing member cover supported on the insulating housing and moveable between an initial position where the sealing member cover is positioned on an outside surface of the sealing member and a final position where the sealing member cover is positioned on an outside surface of the housing main body; and a mating connector having an insulating mating connector housing with a mating member receiving recess that receives the mating member when the waterproof connector and the mating connector are mated, the mating connector having outer walls that engage the sealing member cover to move the sealing member cover from the initial position to the final position.

10. The waterproof connector assembly of claim 9, wherein the sealing member cover compresses the outer periphery of the mating member in the initial position.

11. The waterproof connector assembly of claim 9, wherein the sealing member cover slides over the insulating housing between the initial position and the final position with respect to a direction of mating of the mating connector.

12. The waterproof connector assembly of claim 9, further comprising a locking arm that extends from the insulating housing and locks the sealing member cover in the initial position.

13. The waterproof connector assembly of claim 12, further comprising an engaging member that lifts the locking arm when the sealing member cover moves from the final position to the initial position.

14. The waterproof connector assembly of claim 13, wherein the locking arm locks the mating connector to the waterproof connector when the sealing member cover is in the final position.

15. The waterproof connector assembly of claim 9, wherein the housing main body includes guide grooves that correspond with guide members of the sealing member cover.

16. The waterproof connector assembly of claim 9, wherein the mating member has a smaller diameter than the housing main body.

17. The waterproof connector assembly of claim 9, further comprising an electric wire sealing member attached to the housing main body.

18. The waterproof connector assembly of claim 9, wherein the outer walls of the mating connector compress the sealing member when the sealing member cover is in the final position.

19. A waterproof connector assembly, comprising:

a waterproof connector having an insulating housing with a housing main body and a mating member that extends from the housing main body, the insulating housing having a plurality of contact accommodating cavities extending there through, a sealing member attached to an outer periphery of the mating member, a sealing member cover supported on the insulating housing and moveable between an initial position where the sealing member cover is positioned on an outside surface of the sealing member and a final position where the sealing member cover is positioned on an outside surface of the housing main body, a locking arm extending from the insulating housing that locks the sealing member cover in the initial position; and a mating connector having an insulating mating connector housing with a mating member receiving recess that receives the mating member when the waterproof connector and the mating connector are mated, the locking arm locking the mating connector to the waterproof connector when the sealing member cover is in the final position.

20. The waterproof connector assembly of claim 19, wherein the sealing member cover compresses the outer periphery of the sealing member in the initial position.

21. The waterproof connector assembly of claim 19, wherein the outer walls of the mating connector compress the sealing member when the sealing member cover is in the final position.

22. The waterproof connector assembly of claim 19, wherein the sealing member cover slides over the insulating housing between the initial position and the final position with respect to a direction of mating of the mating connector.

23. The waterproof connector assembly of claim 19, further comprising an engaging member that lifts the locking arm when the sealing member cover moves from the final position to the initial position.

24. The waterproof connector assembly of claim 19, wherein the housing main body includes guide grooves that correspond with guide members of the sealing member cover.

25. The waterproof connector assembly of claim 19, wherein the mating member has a smaller diameter than the housing main body.

26. The waterproof connector assembly of claim 19, further comprising an electric wire sealing member attached to the housing main body.

* * * * *